US005188388A

United States Patent [19]

Rohrmoser

[11] Patent Number: 5,188,388

[45] Date of Patent: Feb. 23, 1993

[54] SKI BINDING WITH A HOLDING MECHANISM FOR THE FRONT AND HEEL JAWS

[75] Inventor: Alois Rohrmoser, Wagrain, Austria

[73] Assignee: Varpat Patentverwertungs AG, Littau, Switzerland

[21] Appl. No.: 883,057

[22] Filed: May 8, 1992

Related U.S. Application Data

[63] Continuation of Ser. No. 483,122, Feb. 22, 1990, abandoned.

[30] Foreign Application Priority Data

Feb. 22, 1989 [AT] Austria ..... 397/89

[51] Int. Cl.[5] ..... A63C 9/00

[52] U.S. Cl. ..... 280/633; 116/DIG. 11; 280/634

[58] Field of Search ..... 280/623, 633, 634, 635; 292/165; 116/DIG. 11

[56] References Cited

U.S. PATENT DOCUMENTS 4,522,424 6/1985 Luitz et al. ..... 280/633
4,773,886 9/1988 Teeter et al. ..... 280/633 X

FOREIGN PATENT DOCUMENTS 0084324 4/1986 European Pat. Off. .
2432647 3/1975 Fed. Rep. of Germany ..... 280/633
3109754 4/1988 Fed. Rep. of Germany .
2340749 9/1977 France ..... 280/633

OTHER PUBLICATIONS

EPO 0,337,905 Piegay, Oct. 1989.

*Primary Examiner*—Charles A. Marmor
*Assistant Examiner*—Michael Mar
*Attorney, Agent, or Firm*—Collard & Roe

[57] ABSTRACT

The invention relates to a ski binding (1) with a toe-holding unit (2) and a heel-holding unit (3). Release mechanisms (8) are integrated in the latter and can be set to different releasing forces. Detachably fastened on the ski are longitudinal guidance devices (5, 6) for the toe-holding and/or heel-holding unit (2, 3), which are movably connected to the connecting element (4). The toe-holding and/or heel-holding unit (2, 3) can be fixed by an arresting device (17) for fixing the toe-holding unit (2) in a longitudinal guidance device (5) and/or a transverse guidance device (74).

7 Claims, 6 Drawing Sheets

SKI BINDING WITH A HOLDING MECHANISM FOR THE FRONT AND HEEL JAWS

This application is a continuation of co-pending U.S. patent application Ser. No. 07/483,122, filed Feb. 22, 1990 now abandoned.

BACKGROUND OF THE INVENTION

The invention describes a ski binding with a toe-holding unit and a heel-holding unit and release mechanisms, which are integrated in the latter and can be set to different releasing forces, and a longitudinal guidance device, detachably fastened on the ski, for the toe-holding and/or heel-holding unit, and a connecting element which is movably connected to the toe-holding unit and/or heel-holding unit and is flexibly deformable vertically to a mounting surface of the toe-holding and/or heel-holding unit but resistant to tension.

A ski binding is already known—according to German Patent Specification 3,109,754—in which a toe-holding or a heel-holding unit of a ski binding is arranged adjustably relative to a longitudinal guide connected fixedly to a ski. The toe-holding unit and the heel-holding unit of this ski binding are moreover connected to each other in an articulated fashion via a connecting element. The toe-holding unit can then be set with one and the same arresting device both with respect to a notched strip connected to the longitudinal guide and in its relative position with respect to the connecting element. By unscrewing an arresting pin of the arresting device, which pin can be adjusted via a thread in the toe-holding unit perpendicularly to a mounting surface of the same, the movement of the toe-holding unit can be released while maintaining connection between the toe-holding unit and the connecting element, so that the toe-holding and heel-holding units, which are connected to each other via the connecting element, can be adjusted jointly relative to the ski in the longitudinal direction of the same. Once the ski binding, consisting of toe-holding and heel-holding units, has reached the new position on the ski, it can be fixed again by screwing in the arresting pin. If, on the other hand, the position of the toe-holding unit is to be changed with respect to the connecting element, the toe-holding unit can be pulled out from the longitudinal guide by means of the connecting element once the arresting pin has been loosened, whereupon it can be placed back onto the connecting element in a changed relative position and pushed back into the longitudinal guide in the new relative position with respect to the connecting element.

In order to simplify this adjustment of the relative position between the toe-holding unit or the heel-holding unit and the connecting element, it is also envisaged in the case of this ski binding that the heel-holding unit resting on the connecting element is mounted free from play displaceably in height in an own longitudinal guide, the connecting element having a serrated strip or recesses arranged one after the other in a row, the spacing of which corresponds essentially to a pitch of a thread of a setting screw. The setting screw is, for its part, mounted rotatably in the housing of the heel-holding unit. By turning the setting screw, the heel-holding unit can now be adjusted in the longitudinal direction of the ski relative to the connecting element. Consequently, a distance between the toe-holding unit and the heel-holding unit can be set and a corresponding pretensioning force attained between this unit and the ski boot.

Furthermore, it is also already known—according to European Patent Specification 84,324—to provide the toe-holding unit with a swivel lever extending over its upper side. The said lever is able to swivel on the end face of the toe-holding unit away from the heel-holding unit about an axis running parallel to the mounting surface and transversely to the longitudinal centre axis of the ski binding. The swivel lever also has a continuation, which engages underneath a swivel arm upon swivelling in the direction of the toe-holding unit away from the heel-holding unit. In a position up against the upper side of the toe-holding unit, the swivel arm is pressed under resilient pretension against a notched strip, so that an arresting pin is pressed into the recesses of the notched strip and consequently the position of the toe-holding unit with respect to the ski is fixed in the longitudinal direction of the ski. If, on the other hand, the swivel lever is swivelled forwards, the catch and the notched strip disengage and the toe-holding unit can be displaced freely relative to the notched strip.

SUMMARY OF THE INVENTION

The present invention is now based on the object of providing a ski binding with which the fixing of the toe-holding or heel-holding unit in various positions is simplified.

This object of the invention is achieved by the fact that the toe-holding and/or the heel-holding unit can be fixed by an arresting device for fixing the toe-holding unit in a longitudinal guidance device and/or a transverse guidance device Due to the design according to the invention, it is now possible in a surprisingly easy way to achieve a central position of the toe-holding or heel-holding unit and/or any position of the toe-holding or heel-holding unit relative to the ski in the longitudinal direction of the ski.

Furthermore, it is also possible that the toe-holding unit and/or the heel-holding unit is arranged displaceably in a longitudinal guidance device, thereby permitting the individual adjusting operations with exact centring of the toe-holding or heel-holding unit.

According to another embodiment, it is envisaged that a part of the longitudinal guidance device is designed as a notched strip or is connected to a notched strip, assigned to which is a catch of the arresting device, which catch is preferably adjustable perpendicularly to the notched strip and can be adjusted by means of an actuating member formed by an eccentric pin out of an arresting position engaging in a recess of the notched strip into an unlocking position, thereby providing a secure and simple arrest with few moving parts which also functions satisfactorily at extremely differing outside temperatures, as is the case in skiing.

It is also advantageous if the catch of the arresting device is arranged on a swivel arm running parallel to the longitudinal guidance device, which arm can be adjusted in the toe-holding or heel-holding unit essentially perpendicularly to the mounting surface about a swivel axis running parallel to the mounting surface of the toe-holding or heel-holding unit but transversely to the longitudinal direction of the longitudinal guidance devices. By using the swivel arm, a continuous adjustment of the catch relative to the notched strip can be achieved.

Furthermore, it is also possible that the swivel axis is arranged closer to a holding device for the ski boots and the eccentric pin is arranged in the region of the end of the toe-holding or heel-holding unit away from the holding device and aligned parallel to the longitudinal direction of the longitudinal guidance device, making possible an actuation preferably from the side of the toe-holding unit away from the heel-holding unit.

According to another design variant, it is envisaged that the swivel arm rests on the side of the eccentric pin away from the mounting surface and is pretensioned in the direction of the notched strip by a spring device, for example a spring element consisting of flexible plastic or rubber, as a result of which a locking or unlocking is possible by turning of the eccentric pin and, if the catch does not coincide precisely with a recess in the notched strip, the pretension exerted by the spring device causes this catch to engage of its own accord in the recess of the notched strip with a slight relative movement between toe-holding unit and notched strip.

However, it is also advantageous if the swivel arm is connected to a signalling pin, which is directed approximately vertically to the mounting surface, bears against an upper side of the toe-holding unit when the swivel arm is in an arresting position and protrudes beyond the upper side in the unlocked position, since this enables the user of such a ski binding to ascertain immediately from the outside whether the toe-holding unit is arrested or locked or not.

However, it is also possible that the eccentric pin is mounted rotatably in the toe-holding unit and is provided with a slit or a hexagon head, making actuation possible with commercially available tools or, if need be, even with a knife.

According to another further development, it is envisaged that the swivel arm is formed by a leaf spring, which is fixed at its end facing the holding device in the housing of the toe-holding unit via a fastening means, for example a rivet, while the end facing an eccentric pin has a leg deformed in an angled shape in the direction of an upper side of the toe-holding unit, by a slot being arranged parallel to the mounting surface, in which slot an eccentric pin of the eccentric drive engages, thereby preventing an unintentional uncoupling between eccentric pin and notched strip.

Furthermore, it is also possible that the connecting element between toe-holding and heel-holding units or a swivel lever is guided in height and to the sides in the longitudinal guidance device and is arranged between the swivel arm of the arresting device and the toe-holding unit, likewise guided to the sides and in height in the longitudinal guidance device, a notched strip, which is movably connected to the ski, being arranged on the side of the swivel arm of the arresting device away from the connecting element or swivel lever, and that both an arresting pin projecting in the direction of the toe-holding unit and an arresting pin projecting in the direction of the notched strip are arranged as catches on the swivel arm and the swivel arm is coupled to the eccentric pin. This embodiment is characterized in an advantageous way in that different adjusting operations, namely both between the toe-holding unit and the connecting element and of the entire ski binding with respect to the ski, can be controlled by means of an arresting device However, it is also advantageous if the transverse guidance device has a holding device for the ski boot which can be swivelled about a swivel axis and is provided on a side facing a guide surface with a pressure plate, which is fastened to the holding device with a spring device interposed, whereby the central position of the holding device can be maintained free from play with low deflecting forces running transversely to the longitudinal axis of the binding and the flexible clamping movements only come into play when these predefined lateral forces are exceeded.

According to another embodiment, it is also possible that, in the guide surface, mushroom-like or spherical segment-shaped catch elements are fastened on the side facing the pressure plate, at least one of which elements in each case is arranged on both sides of a longitudinal centre axis of the toe-holding unit and which engage in recesses in the pressure plate when the holding device is in a position centrally aligned with the longitudinal centre axis. Due to the number of catch elements arranged on both sides of a longitudinal centre axis of the toe-holding unit, the fixing force of the toe-holding unit in the zero position can be predefined or a retaining force which is equal in both directions can be built up.

However, it is also advantageous if the spring device is formed by a layer of plastic or rubber which is arranged between a housing of the toe-holding unit and the pressure plate and is flexibly deformable in a direction perpendicular to the pressure plate, since a uniform deformation and support of the pressure plate is thereby attained, as a result of which a uniform releasing force is achieved.

However, it is also possible that the pressure plate is supported in the housing of the toe-holding unit with helical or leaf springs interposed, the pretension of which can be varied by means of a setting device, as a result of which the retaining force around the zero position can be easily changed.

According to another embodiment, it is envisaged that the holding device can be adjusted by means of an own actuating drive, independently of the housing of the toe-holding unit, in a direction approximately perpendicular to the mounting surface of the toe-holding unit, as a result of which it is easy to compensate for a differing height or sole thickness of the ski boots without the release mechanism of the toe-holding or heel-holding unit being disadvantageously altered thereby. However, it is also advantageous if the toe-holding and/or the heel-holding unit is mounted displaceably parallel to the longitudinal direction of the ski in a longitudinal guidance device and is coupled to a screw spindle which is mounted rotatably in the housing and the thread of which engages in a notched or serrated strip and that the screw spindle is coupled to an adjusting device formed by a ratchet drive, as a result of which an enforced relative adjustment between the ski binding and the ski is attained.

In this case, it is possible that an actuating member for the ratchet drive and/or a changeover device with a receiving opening for a ski stick is provided, as a result of which the actuation of the ratchet drive while the skier is standing is possible and therefore an adjustment can be carried out at any time during the course of a descent if there is a corresponding change in skiing conditions.

BRIEF DESCRIPTION OF THE DRAWINGS

For a better understanding of the invention, it is explained in further detail below with reference to the exemplary embodiments represented in the drawings, in which.

DETAILED DESCRIPTION OF THE PREFERRED EMBODIMENTS

Figure 1:
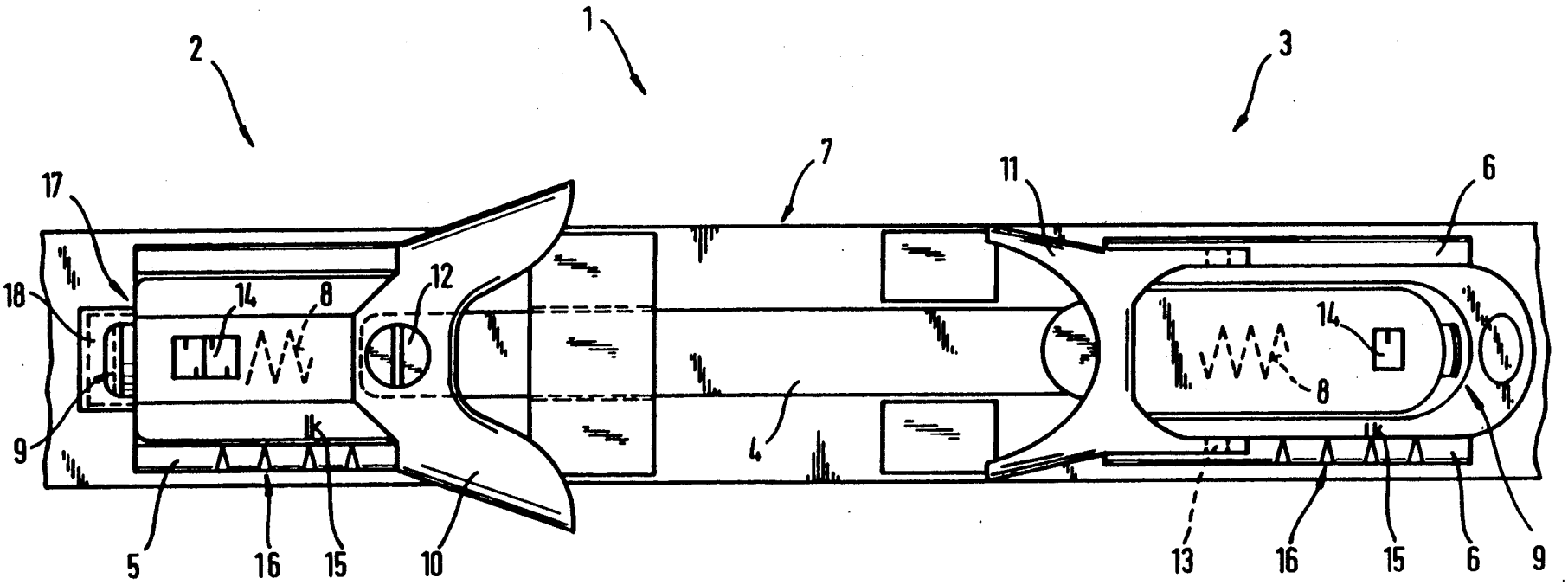
FIG. 1 shows a ski binding according to the invention, mounted on a ski, in plan view and simplified schematic representation.

Represented in FIG. 1 is a ski binding 1, which consists of a toe-holding unit 2, a heel-holding unit 3 and a connecting element 4 connecting the two. In the present exemplary embodiment, both the toe-holding unit 2 and the heel-holding unit 3 are mounted displaceably in a longitudinal guidance device 5 and 6 respectively. Either the toe-holding unit 2 or the heel-holding unit 3 may be fixed immovably in the longitudinal direction of a ski 7 on the latter, while the other unit opposite it, held by means of the connecting element 4, is guided freely displaceably in the longitudinal guidance device 5 or 6. Both the toe-holding unit 2 and the heel-holding unit 3 are equipped with a release mechanism 8, which free a lateral movement of the holding device 10 for a ski boot in the region of the toe-holding unit 2 and a holding device 11 in the region of the heel-holding unit 3 if a releasing force, which can be predetermined by a setting member 9, is exceeded. After freeing of the release mechanism 8, the holding device 10 can be swivelled without force about a swivel axis 12 in a plane parallel to a mounting surface of the toe-holding unit 2, while the holding device 11 of the heel-holding unit 3 can be swung up about a horizontal transverse axis 13 in a direction away from the mounting surface and thus likewise frees the ski boot. To check the setting and the releasing forces or the release mechanism, indicating members 14 are arranged both in the toe-holding unit 2 and in the heel-holding unit 3. The toe-holding and heel-holding units 2, 3 are also provided with a marking 15, which interacts with position marks 16 arranged on the longitudinal guidance devices 5, 6. For adjusting the marking 15 with respect to the position marks 16, an arresting device 17 can be released by means of an actuating member 18. This has the effect that, for example, the rigid connection between the longitudinal guidance device 5 and the toe-holding unit 2 is released and the toe-holding unit 2 can then be shifted in the longitudinal direction of the ski 7 by also taking with it the heel-holding unit via the connecting element 4. By actuating the actuating member 18, the ski binding 1 can be fixed in the new position in coincidence with one of the position marks 16 by means of the arresting device 17.

Figure 2:
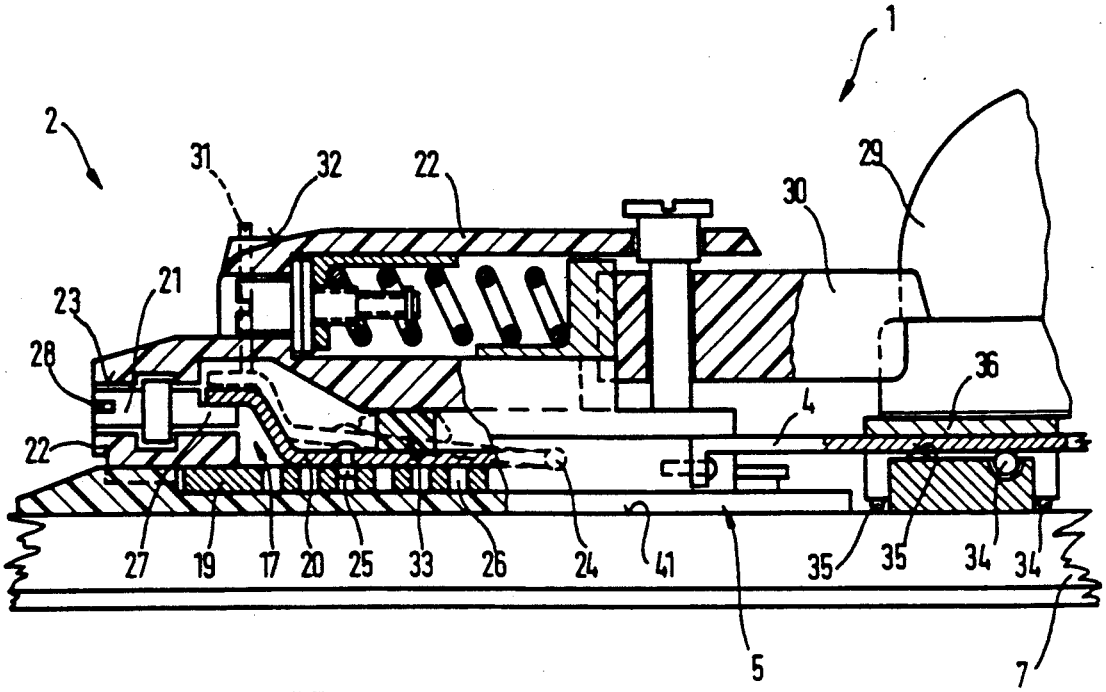
FIG. 2 shows a toe-holding unit in a ski binding, sectionally in side view and in simplified schematic representation.

Shown in FIG. 2 is an arresting device 17, with which a toe-holding unit 2, but it could equally well be the heel-holding unit 3, can be fixed in its position with respect to a ski 7. For this purpose, the arresting device 17 comprises a longitudinal guidance device 5, in which a notched strip 19 is arranged on the side facing the ski 7. Of course it is also possible that this notched strip 19 is formed by the base plate of the longitudinal guidance device 5 connected to the ski 7. This notched strip 19 is assigned a swivel arm 20, which can be adjusted by means of an eccentric drive 21, which is mounted rotatably in a bore 23 in a housing 22 of the toe-holding unit 2, in height out of the position drawn in solid lines into the position drawn in broken lines. At its end opposite the eccentric drive 21, the swivel arm 20 is mounted pivotally about a swivel axis 24 in the housing 22. In the position of the swivel arm 20 drawn in solid lines, a catch 25, which is movably connected to the swivel arm 20, for example is screwed or riveted to it, engages in recesses 26 of the notched strip 19. A turning of the eccentric drive 21 has the effect of turning an eccentric pin 27. This turning may be performed, for example, by means of a screwdriver, which can be inserted into a slit 28 of the eccentric drive 21. This turning has the effect that the swivel arm 20 resting on the eccentric pin 27 is raised into the position shown by broken lines and the catch 25 leaves the recesses 26 of the notched strip 19. Once this has taken place, the movement of the toe-holding unit 2 with respect to the ski 7 is freed and the ski binding 1 can be shifted relative to the ski 7 in the longitudinal direction of the latter jointly with the ski boot 29 clamped in the said binding, which boot is held in the toe-holding unit 2 by means of the holding device 30. Once the toe-holding unit 2 has been adjusted by the desired amount, the eccentric drive 21 is turned back again into its initial position, so that the catch 25 can engage in a recess 26 of the notched strip 19 and consequently the toe-holding unit 2 can be fixed with respect to the ski 7.

In order to ensure that the catch 25 engages in a recess 26 and the toe-holding unit 2 is fixed with respect to the ski 7, it is possible to connect the swivel arm 20 to a signalling pin 31, which, with the swivel arm 20 in the raised position represented by broken lines, projects beyond an upper side 32 of the toe-holding unit 2. It is thus clearly evident to the user of such a ski binding 1 that the toe-holding unit 2 is not yet locked and he can make the catch 25 engage in a recess 26 of the notched strip 19 by a slight relative movement between ski 7 and toe-holding unit 2. In order to assist this engagement and prevent the catch 25 jumping out of the recess 26 due to vibrations and oscillations during the use of the ski, a spring device 33, which may for example be formed by a flexibly deformable rubber or plastic plate or the like, may be arranged between the housing 22 of the toe-holding unit 2 and the swivel arm 20. In order to promote the displacement of the ski boot 29 with respect to the ski 7, in particular whenever the said boot is to be displaced jointly with the ski binding 1 relative to the ski 7, the connecting element 4, which connects the toe-holding unit 2 to the heel-holding unit 3, may be supported on its under side facing the ski 7 by means of rollers 34 or friction-reducing roller-type elevations 35. Such rollers 34 or elevations 35 facilitate the adjustment of the ski binding 1 with clipped-on ski boot 29. Moreover, a supporting plate 36, extending over the connecting element 4 in the manner of a bridge, may be provided in the region of the holding device 30 of the toe-holding unit 2. The said supporting plate may be equipped on its ends facing the ski 7 with friction-reducing rollers 34 or elevations 35.

Figure 3:
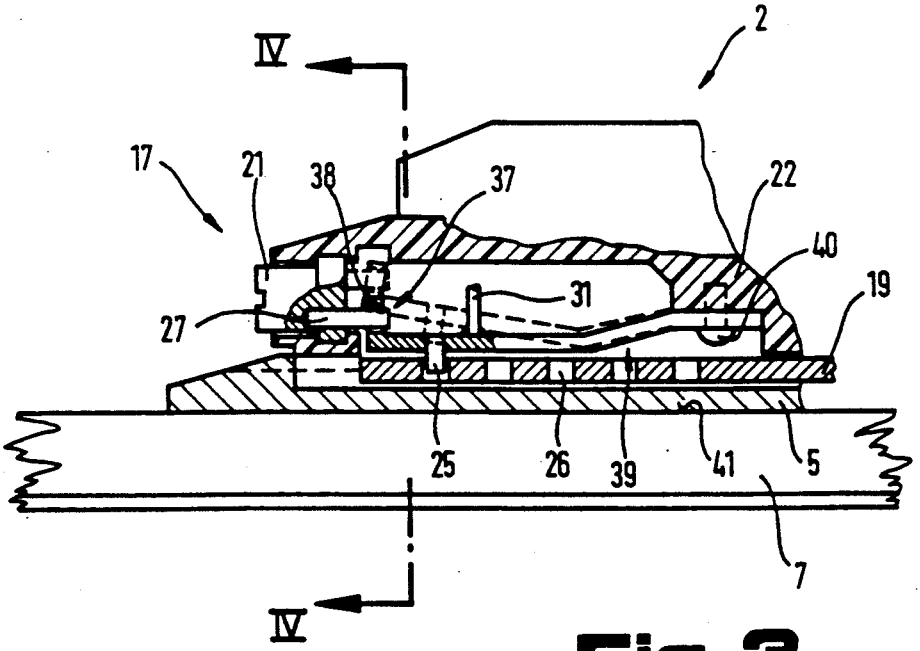
FIG. 3 shows another design variant of an arresting device between a toe-holding or heel-holding unit of a ski binding in side view, partially in section and in simplified schematic representation.
Figure 4:
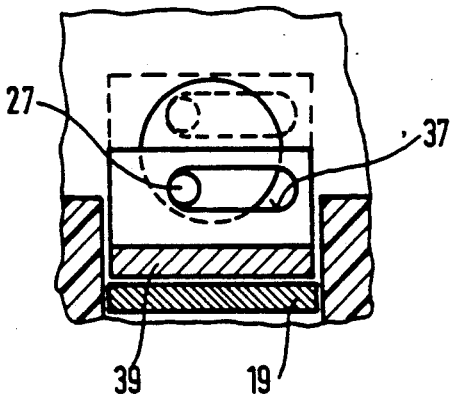
FIG. 4 shows the toe-holding unit in the region of the arresting device in an end-on view sectionally along the lines IV—IV in FIG. 3.

In the case of a design variant of an arresting device 17 shown in FIGS. 3 and 4, an eccentric pin 27 is guided in a slot 37 and mounted displaceably, transversely to the ski 7, in a leg 38 of a swivel arm 39. The swivel arm 39 is designed as a spring clip and consists, for example, of a stainless spring plate and is fastened at one end in the housing 22 of the toe-holding unit 2 via a fastening means 40, for example a screw or a rivet. By a turning of the eccentric drive 21, the eccentric pin 27, arranged eccentrically in the drive, moves both in the direction of its height, that is to say vertically to a mounting surface 41 of the toe-holding unit 2, and at the same time also transversely to a longitudinal axis of the binding. This transverse movement is taken up by the slot 37. At the same time, the vertical adjustment of the eccentric pin 27 causes the swivel arm 39 to be raised out of the position drawn in solid lines into the position drawn in broken lines and the catch 25 to leave the recesses 26 of the notched strip 19. Consequently, the toe-holding unit 2 can be adjusted freely with respect to the longitudinal guidance device 5. If the eccentric pin 27 is returned to its initial position, the catch 25 is under a flexible pretension directed in the direction of the ski 7 and therefore engages of its own accord in a recess 26. In the event that the catch 25 comes to rest on the notched strip 19 between two recesses 26, this engaging movement can be effected by a short relative displacement between the toe-holding unit 2 and the skis 7.

In order to make it clearly evident to the user whether the toe-holding unit 2 is fixed properly or not in this case as well, the swivel arm 39 may also be coupled to a signalling pin 31, as schematically indicated.

It is of particular advantage in this case if the slot is designed in such a way that it serves at the same time as a stop for the eccentric pin 27. As can be seen from FIG. 4, the eccentric pin is moved in each case beyond the upper and lower dead centres. If the upper dead centre is exceeded, the intrinsic resilient force of the swivel arm 39 causes a tensile force to be exerted in the direction of the ski 7, tending to displace the eccentric pin further to the side in the slot 37. This is not possible due to the end of the slot. In order to prevent this happening nevertheless, by a lateral deformation of the swivel arm 39, the latter may be guided on both sides. In the same way, the swivel arm 39 is arrested in the lower end position since, when there is a tendency of the swivel arm 39 to lift off in the direction of the toe-holding unit 2, which would mean that the catch 25 would leave the recess in the notched strip 19, this movement is likewise limited by the length of the slot. The flexibility of the plastic housing acts in this case like a strong spring. It also accomplishes the overcoming of a dead centre in the highest and lowest positions of the eccentric pin 27.

Figure 5:
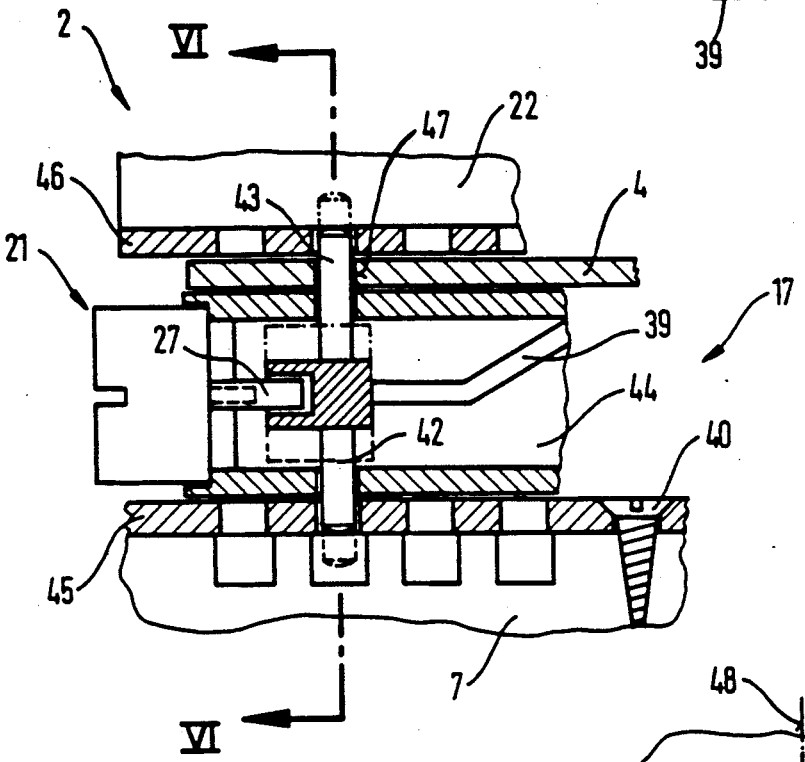
FIG. 5 shows a design variant of an arresting device designed according to the invention for a toe-holding or heel-holding unit of a ski binding in sectional side view and in schematic representation.
Figure 6:
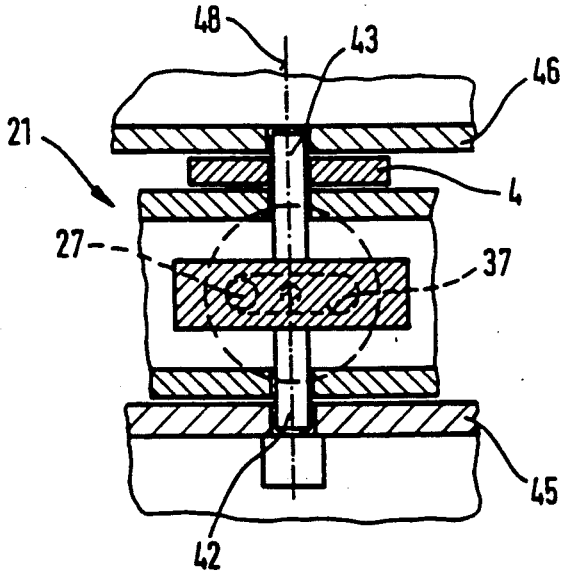
FIG. 6 shows the arresting device in the region of a toe-holding or heel-holding unit in an end-on view sectionally along the lines VI—VI in FIG. 5.

Shown in FIGS. 5 and 6 is an embodiment for an arresting device 17 of a toe-holding unit 2 in which two catches or arresting pins 42 and 43, aligned in opposite directions, are arranged for example on a swivel arm 39 connected to an eccentric pin 27 according to FIG. 3. Like the eccentric drive 21, the swivel arm 39, which is made in particular of a spring material, for example of a spring steel, is arranged in a housing 44 connected to the connecting element 4. By turning the eccentric pin 27 in opposite directions, either the arresting pin 42 or the arresting pin 43 is then moved away from the notched strips 45, 46 assigned to them. For this purpose, the notched strip 46 is arranged in a housing 22 of the toe-holding unit 2, while the notched strip 45 is arranged fixedly on the ski 7 by fastening means 40, for example screws. The connecting element 4, through which the arresting pin 43 passes in a bore 47, is led through between the swivel arm 39 and the notched strip 46. Since the two arresting pins 42, 43 are arranged on the same side with respect to an axis of symmetry 48, an adjustment or turning of the eccentric pin 27 in the direction of the notched strip 45 can cause the arresting pin 43 to leave the notched strip 46, so that the toe-holding unit 2 can be adjusted freely in the longitudinal direction of the ski relative to the connecting element and held fixed by means of the connecting element 4. After choosing the required position, the eccentric pin 27 is returned from its position shown in broken lines in FIG. 6 into the position shown in solid lines, in which the slot 37 is in a horizontal position, as a result of which the toe-holding unit 2 is again clearly fixed with respect to the connecting element 4 and the ski 7. If, on the other hand, the entire ski binding 1, consisting of toe-holding unit 2 and heel-holding unit 3, is to be displaced relative to the ski 7, the eccentric pin 27 is swivelled into the position shown in dot-dashed lines and the arresting pin 42 leaves the notched strip 45. This allows the toe-holding unit 2 to be displaced with the heel-holding unit 3, held by means of the connecting element 4, relative to the ski 7 and arrested again in a new relative position via the arresting pin 43 by a readjustment of the eccentric pin 27 into the position shown in solid lines.

Figure 7:
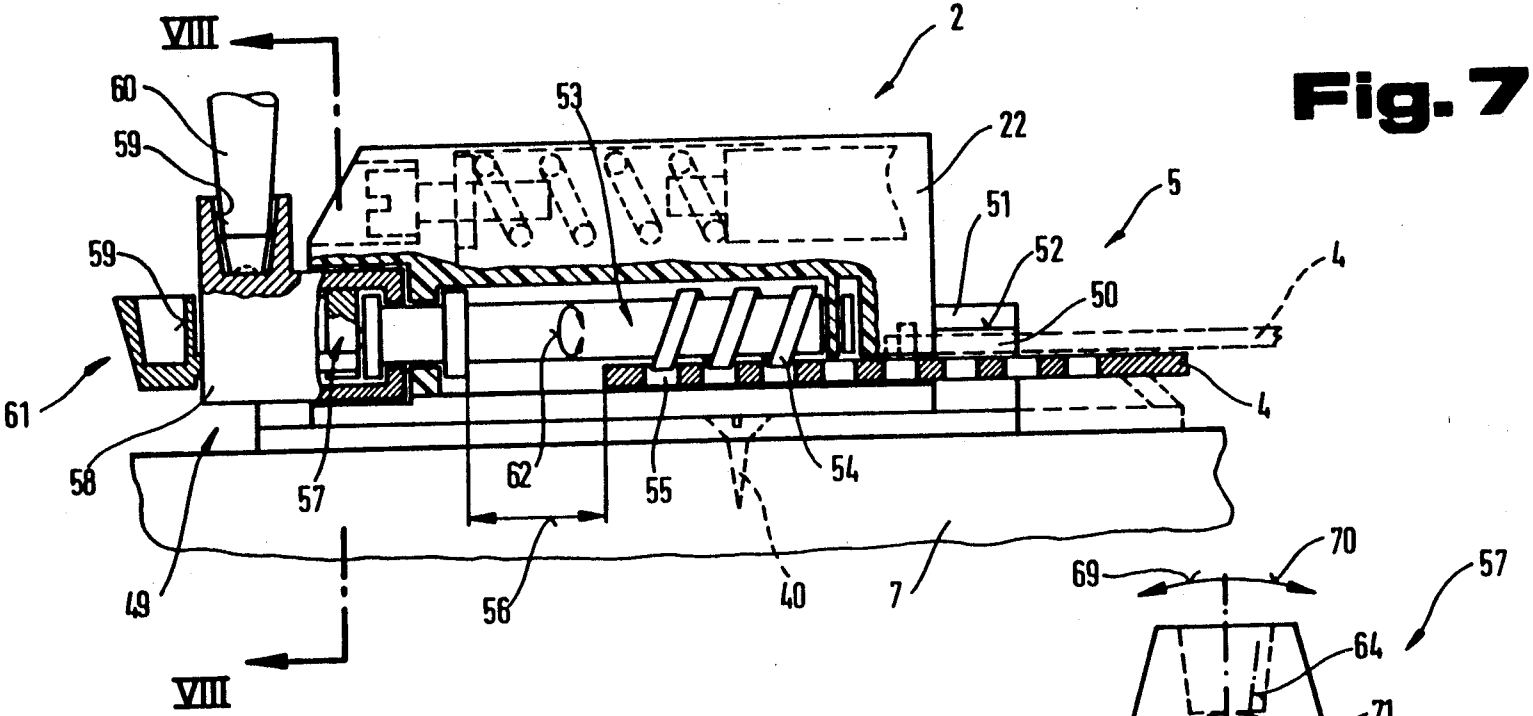
FIG. 7 shows an adjusting device for a toe-holding or heel-holding unit in side view, partially in section and simplified schematic representation.
Figure 8:
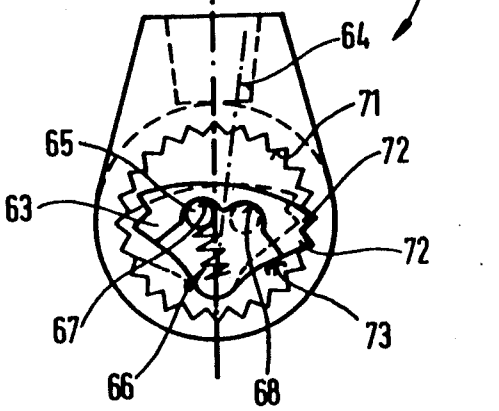
FIG. 8 shows the adjusting device in an end-on view sectionally along lines VII—VII in FIG. 7.

Shown in FIGS. 7 and 8 is an adjusting device 49 for an enforced relative adjustment of a toe-holding or heel-holding unit 2 or 3 relative to the ski 7. A longitudinal guidance device 5 for the toe-holding unit 2 is mounted fixedly on the ski 7 via fastening means 40, for example screws. The housing 22 of the toe-holding unit 2 is guided by means of lateral guidance strips 50 in the direction transverse to the ski 7 and the toe-holding unit 2 is by means of vertical guidance strips 51, which are supported on shoulders 52 of the housing 22 and consequently press a screw spindle 53, arranged in the housing 22, in the direction of a connecting element 4, which is provided with recesses 55 arranged in the spacing of a pitch of the thread 54. The toe-holding unit 2 can consequently be displaced at any time jointly with the connecting element 4 relative to the longitudinal guidance device 5. By the screw spindle 53 however, the relative position of the toe-holding unit to the connecting element 4 can be altered as desired. Thus, at least an adjustment range 56 is possible, which can be lengthened as desired if the connecting element 4 or the pitch of the thread 54 are designed correspondingly.

The adjusting device 49 has a ratchet drive 57, the actuating member 58 of which has a receiving opening 59 for a ski stick 60. By swivelling the actuating member 58 with the ski stick 60, the screw spindle 53 can be moved in one of the two directions drawn in by a double-headed arrow 62, depending on the position of a change-over device 61, which can be actuated via projecting studs by placing the ski stick 60 on them or by means of a receiving opening 59, likewise with the ski stick 60. With the changeover device 61, a sliding block 63, which is arranged inside the ratchet drive 57 and can be swivelled about a tilt axis 64, is adjusted by means of a swivel lever 65, which engages in one of two recesses 67, 68 via a spring 66 by means of the changeover device. As a result, the sliding block 63 is adjusted into a position in which it can yield by the action of the spring 66 if there is a movement in the direction of an arrow 69 and thus permits a relative movement between the actuating member 58 and the screw spindle 53, while in the opposite direction according to an arrow 70 the internal toothing 71 engages in the teeth 72 and, since a turning of the sliding block 63 is prevented by a stop 73, the screw spindle 53 is taken along. If the swivel lever 65 is swivelled by means of the changeover device 61, so that it engages in the recess 68, a free movement of the actuating member 58 actuated by the ski stick 60 in the direction of the arrow 69 and a rotationally fixed connection between the actuating member 58 and the screw spindle 53 upon turning in the direction of the arrow 70 are possible.

Consequently, using this adjusting device 49 with a ratchet drive 57, it is now possible for the first time to adjust the entire ski binding 1 or else, depending on the embodiment, only the toe-holding unit 2 or the heel-holding unit 3, in any desired direction of the ski 7.

Figure 9:
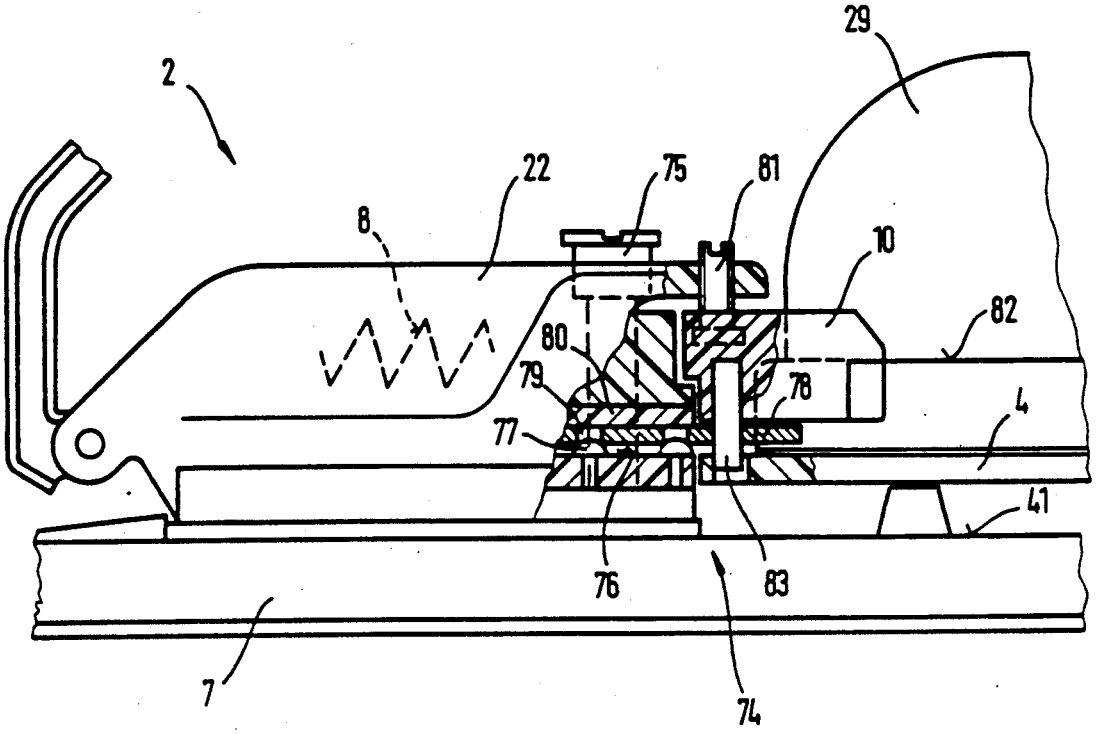
FIG. 9 shows a toe-holding unit of a ski binding with a transverse guidance device designed according to the invention in side view, partially in section and simplified schematic representation.
Figure 10:
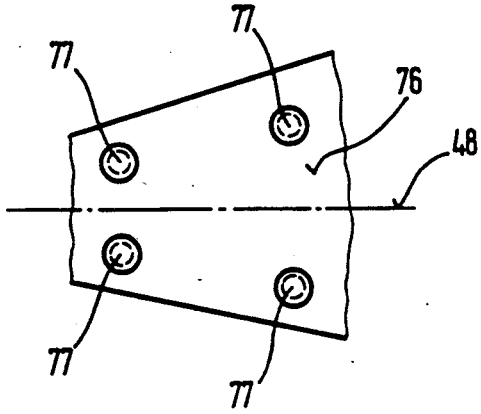
FIG. 10 shows the guide surface of the transverse guidance device according to FIG. 9 in plan view.

A transverse guidance device 74 for the toe-holding unit 2 relative to the ski 7 is shown in FIGS. 9 and 10. The toe-holding unit 2 can be swivelled transversely to the ski 7 about a swivel axis 75 and against a release mechanism 8, for example a helical spring, which fixes a releasing force. In order to prevent a swinging of the holding device 10 about the swivel axis 75 in the range of low lateral forces acting in a releasing direction, the toe-holding unit or the holding device 10 is fixed by the transverse guidance device 74 in a direction running centrally to an axis of symmetry 48 of the toe-holding unit 2 until a predefinable force acting in the releasing direction occurs. Only when this lateral force is exceeded does the further damping and support of the toe-holding unit 2 or of the holding device 10 exclusively via the release mechanism 8 take place. The transverse guidance device 74 now comprises a guide surface 76 in which, as can be seen better from FIG. 10, four catch elements 77 are arranged, which may for example form the corner points of a trapezium or of a square or the like. These catch elements 77 are of mushroom-shaped or spherical segment-shaped design in their regions facing a pressure plate 78 and facing over the guide surface 76. Recesses 79 are arranged in the pressure plate 78 in the same arrangement or at the same grid dimensions as the catch elements 77.

The pressure plate 78 is pressed against the guide surface 76 by the action of a spring device 80, in the present case for example a plate of flexibly deformable rubber or plastic, so that the mushroom-shaped or spherical segment-shaped projections of the catch elements engage in the recesses 79 of the pressure plate 78. If the lateral forces acting on the toe-holding unit 2, which occur due to a relative movement between the ski boot 29 and the ski 7, exceed the retaining force exerted by the interacting of the spring device and the pressure plate, the holding device 10 or the toe-holding unit 2 springs away laterally about a swivel axis 75, since the pressure plate 78 is pressed away from the ski 7 by the action of the spring device 80 and consequently the pressure plate 78 comes to rest on the end faces of the catch elements 77 and the toe-holding unit 2 or the holding device 10 is then held in its position relative to the ski by means of the release mechanism 8. It is also shown in this representation that the holding device 10 can be adjusted relative to the housing 22 by means of an actuating drive 81 approximately perpendicularly to the mounting surface 41 of the toe-holding unit 2, so that the holding device 10 can be fixed to various heights of a sole edge 82. An articulation axis 83, by means of which the connecting element 4, which for example connects the toe-holding unit 2 to the heel-holding unit 3, is supported on the toe-holding unit 2, is mounted in the holding device 10.

Figure 11:
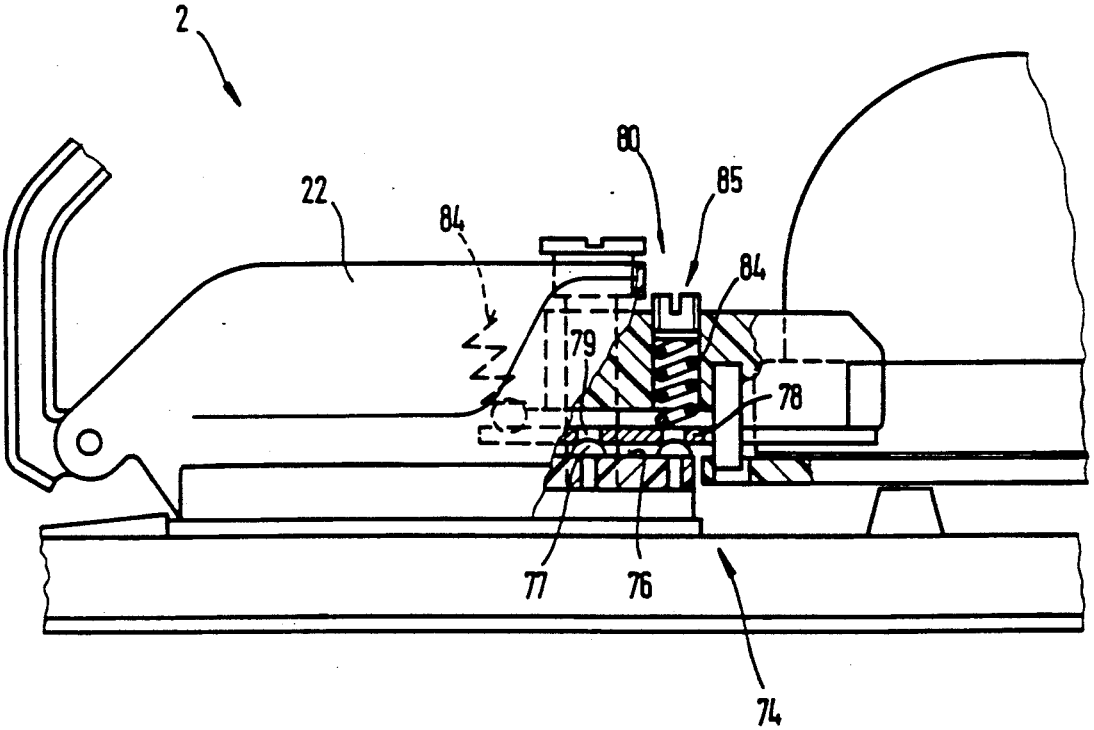
FIG. 11 shows another embodiment of a transverse guidance device according to the invention for a toe-holding unit of a ski binding in side view, partially in section and greatly simplified schematic representation.

Shown in FIG. 11 is a transverse guidance device 74 similar to the embodiment in FIGS. 9 and 10, for which reason the same reference numerals are used for the same parts. The toe-holding unit 2 is again provided with a pressure plate 78, which engages with its recesses 79 in spherical segment-shaped or mushroom-shaped stops projecting with respect to a guide surface 76. The pressure plate 78 is pretensioned under spring pretension against the guide surface 76 in the housing 22 of the toe-holding unit 2 by means of spring devices 80 formed by two helical springs 84. The pretensioning force of the pressure plate 78 can be increased or reduced by means of setting devices 85, for example threaded pins, which compress the helical springs 84 to a greater extent. The action of the transverse guidance device 74 otherwise corresponds to that described with reference to FIGS. 9 and 10.

Finally it should be stated as a matter of routine that the features according to the invention which are described above are not restricted to the design represented of the toe-holding and heel-holding units and the release mechanisms thereby shown. Rather, any desired horizontally, vertically or diagonally releasing toe-holding and heel-holding units known from the prior art may be used. Furthermore, the individual exemplary embodiments shown in the drawings and also parts thereof may in each case form independent solutions according to the invention on their own.

I claim:

1. A ski binding for a longitudinally extending ski comprising:

a toe clamp with an adjustable release mechanism mounted on the ski;

a heel clamp with a second adjustable release mechanism mounted on the ski in operative relationship to said toe clamp;

connection means for altering the position of at least one of said clamps with respect to the other of said clamps, including a notched track fastenable on the ski, an arresting device including a swivel arm having two ends and a central portion thereof, said swivel arm extending parallel to the longitudinal direction of the ski and being pivotably connected to at least one of the clamps, said swivel arm being pivotal in a plane perpendicular to the top side of the ski about an axis which is generally parallel to the top surface of the ski and generally perpendicular to the longitudinal direction of the ski, the pivot axis being located at one end of said swivel arm;

an actuating member formed as a cylindrical cam having an end with a cutout for engaging said swivel arm at the end opposite the pivot axis and pivoting said swivel arm between two terminal positions including a locked position in which said at least one clamp is fixed with respect to said track and an unlocked position in which said at least one clamp can be moved along said track, in the locked position said central portion of said swivel arm being removably engaged with said noticed track, said cylindrical cam rotatably mounted with the clamp and being rotatable about its central axis which is generally parallel to the longitudinal direction of the ski and said swivel arm, the release mechanism being accessible and adjustable independently of the position of said pin and said swivel arm; and spring means for continuously biasing said swivel arm toward the locked position in the direction of said notched track and the ski, the cutout of said cylindrical cam providing a surface in each terminal position where said spring means and said swivel arm exert force on said end of said cylindrical cam in a direction transverse to its direction of rotation so that said swivel arm does not effect the moment of said cylindrical cam and is maintained in the terminal position until external actuation of said cylindrical cam.

2. The ski binding according to claim 1, wherein said at least one clamp is adjustable along the longitudinal direction of the ski.

3. The ski binding according to claim 1, wherein each clamp has a boot engaging end and an opposite end and wherein said swivel arm is located near the boot engaging end and said cylindrical cam is located near the opposite end, so as to provide access to said cam from the opposite end.

4. The ski binding according to claim 3, wherein said spring means biases said swivel arm in the direction of the ski and said cam so that said cam can be rotated to move the swivel arm away from the ski against the biasing force of said spring means.

5. The ski binding according to claim 1, wherein said eccentric pin is provided with a slit head.

6. The ski binding according to claim 1, wherein said eccentric pin is provided with a hexagon shaped head.

7. A ski binding for a longitudinally extending ski comprising:

a toe clamp with an adjustable release mechanism mounted on the ski;

a heel clamp with a second adjustable release mechanism mounted on the ski in operative relationship to said toe clamp;

connection means for altering the position of at least one of said clamps with respect to the other of said clamps, including a notched track fastenable on the ski, an arresting device pivotably connected to at least one of the clamps for removably engaging said notched track, and an actuating member formed as an eccentric pin for pivoting said arresting device between a locked position in which said at least one clamp is fixed with respect to said track and an unlocked position in which said at least one clamp can be moved along said track, said eccentric pin rotatably mounted within the clamp and being rotatable about an axis generally parallel to the longitudinal direction of the ski, the release mechanism being accessible and adjustable independently of the position of said pin and said arresting device;

a signaling pin which protrudes from the at least one clamp when said arresting device is in an unlocked position, and which retracts into said at least one clamp when said arresting device is in a locked position, to provide simple visual confirmation of the position of said arresting device.

* * * * *